US006237552B1

(12) United States Patent
Hoag, Jr.

(10) Patent No.: US 6,237,552 B1
(45) Date of Patent: May 29, 2001

(54) MOTORCYCLE ROCKER ARM

(76) Inventor: Allen James Hoag, Jr., 308 Pleasant Meadows Blvd., Cuyahoga Falls, OH (US) 44224

( * ) Notice: Subject to any disclaimer, the term of this patent is extended or adjusted under 35 U.S.C. 154(b) by 0 days.

(21) Appl. No.: 09/387,162

(22) Filed: Aug. 31, 1999

(51) Int. Cl.[7] ..... F01L 1/26

(52) U.S. Cl. ..... 123/90.22; 123/90.4; 123/90.42; 123/90.45; 74/559

(58) Field of Search ..... 123/90.39, 90.4, 123/90.41, 90.42, 90.43, 90.47, 90.27, 90.16, 90.15, 90.17, 90.45, 90.22; 74/519, 559

(56) References Cited

U.S. PATENT DOCUMENTS

| | | | | |
|---|---|---|---|---|
| 4,023,543 | | 5/1977 | Ishikawa | 123/75 |
| 4,258,671 | * | 3/1981 | Takizawa | 123/90.16 |
| 4,603,663 | | 8/1986 | Giocastro | 123/90.17 |
| 4,638,774 | * | 1/1987 | Aoi | 123/90.22 |
| 4,697,473 | * | 10/1987 | Patel | 74/519 |
| 4,726,332 | * | 2/1988 | Nishimura et al. | 123/90.16 |
| 4,848,285 | * | 7/1989 | Konno | 123/90.16 |
| 4,913,104 | * | 4/1990 | Mills | 123/90.4 |
| 5,020,488 | * | 6/1991 | Watanabe | 123/90.16 |
| 5,251,585 | * | 10/1993 | Graber | 123/90.39 |
| 5,259,346 | * | 11/1993 | Mills | 123/90.39 |
| 5,445,117 | * | 8/1995 | Mendler | 123/90.16 |
| 5,529,033 | * | 6/1996 | Hampton | 123/90.16 |
| 5,657,726 | * | 8/1997 | Diggs | 123/90.36 |
| 5,680,835 | * | 10/1997 | Ruffing et al. | 123/90.16 |
| 5,743,219 | | 4/1998 | Iio et al. | 123/54.4 |
| 5,960,756 | * | 10/1999 | Miyachi et al. | 123/90.16 |
| 6,055,951 | * | 5/2000 | Rommer et al. | 123/90.22 |

FOREIGN PATENT DOCUMENTS

| | | | | |
|---|---|---|---|---|
| 63-230916 | * | 9/1988 | (JP) | 123/90.39 |
| 404339110A | * | 11/1992 | (JP) | 123/90.39 |
| 405026011A | * | 2/1993 | (JP) | 123/90.39 |
| 405033610A | * | 2/1993 | (JP) | 123/90.39 |
| 405086817A | * | 4/1993 | (JP) | 123/90.39 |
| 406108809A | * | 4/1994 | (JP) | 123/90.39 |

* cited by examiner

*Primary Examiner*—Weilun Lo
(74) *Attorney, Agent, or Firm*—Renner, Kenner, Greive, Bobak, Taylor & Weber

(57) ABSTRACT

A rocker arm (10) that reduces frictional forces between a cam (86) and the rocker arm (10) is disclosed. The rocker arm (10) includes a pair of spaced side members (20) having a valve portion (14), a middle portion (16), and a pivot portion (12). The side members (20) of rocker arm (10) each define a downwardly extending tappet hole (49) located generally centrally within the valve portion (14). The middle portion (16) of each side member (20) defines a bearing hole (68), and each of the pivot portions (12) defines a pivot hole (66). A web (70) extends between side members (20) at a valve portion (14) and at the pivot portion (12), defining a recess (85) therebetween at about the middle portion (16). A pin bearing is located within the bearing holes (68) and passes through the recess (85). An annular striking member (80) is located within the recess (85) and rotatably engages the pin bearing (69). During operation, a cam (86) is placed in operative contact with striking member (80). Rotation of cam (86) depresses striking member (80) and, in turn, rocker arm (10), while frictional forces from the cam cause the striking member (80) to rotate.

8 Claims, 4 Drawing Sheets

MOTORCYCLE ROCKER ARM

TECHNICAL FIELD

The present invention relates to internal combustion engines. More particularly, the present invention relates to a rocker arm for controlling the delivery of air or fuel to an internal combustion engine.

BACKGROUND ART

One example of a known internal combustion engine is contained in U.S. Pat. No. 5,743,219, incorporated by reference herein. At the heart of this engine is a plurality of cylinders that house pistons. The cylinders are in communication with air and fuel intakes. Incoming air and fuel is compressed and ignited in a reciprocal fashion that drives the pistons which, through known means, drive the motorcycle's wheel. The timing and amount of fuel and air entering the cylinder is typically controlled by valves. Similarly, valves control the release of exhaust gases after combustion. Operation of these valves may be controlled by cams that selectively open and close the valves during the cam's rotation. The cam profile determines the period and amount of valve displacement. Often the cam is placed in operative contact with a rocker arm that acts as an intermediary between the cam and valve. At times, a single cam uses a rocker arm to actuate more than one valve. The rocker arm is pivotally mounted above and in contact with one or more valves, and a cam rides along the opposite surface of the rocker arm depressing and releasing the rocker arm as it rotates. In turn, the valves are depressed and released by the rocker arm. Typically, rocker arms are spring mounted to maintain contact with the cam.

Known rocker arms for motorcycles employ a raised striking surface made of polished chrome at the point of contact between the cam and rocker arm. A cam located above the striking surface engages the polished chrome striking surface. As the cam rotates, its surface slides across the string surface, creating significant frictional forces. The surface contact between the cam and rocker arm abrades these surfaces and produces heat, shortening the operative life of each component. The heat causes the component materials to expand, increasing the functional forces and wear. Due to the cyclic motion of the cam, the amount of contact increases with engine speed. At elevated engine speeds, the wearing of the polished chrome surface forms minute beads or balls of chrome material on the surface of the striking plate. These beads dramatically abrade the cam and striking plate surfaces in a short period of time. This abrasion significantly shortens cam and rocker arm life.

In further detriment, the frictional forces between the plate and cam sap the engine's usable horsepower. The force needed to rotate the cam is related to the frictional forces because these must be overcome to rotate the cam. Since more horsepower is committed to rotating the cam, less horsepower is available to drive the motorcycle and, thus, the motorcycle suffers reduced performance.

Therefore, there is a need for a rocker arm that improves cam and rocker arm life and reduces the frictional forces between the cam and rocker arm.

SUMMARY OF THE INVENTION

It is thus an object of the present invention to provide a rocker arm that reduces the frictional contact between the cam and rocker arm.

It is another object of the present invention to provide a rocker arm with improved operational life.

It is a further object of the present invention to provide a rocker arm that lengthens the operating life of a cam in operational contact with the rocker arm.

The foregoing and other objects of the present invention, which shall become apparent as the detailed description proceeds, are achieved by a rocker arm comprising two-spaced side members having a pivot portion, a middle portion, and a valve portion, the side members each defining a downwardly extending tappet hole located generally centrally within the valve portion, the middle portion of each side member defining a bearing hole, and each of the pivot portions defining a pivot hole; a first web portion extended between the side members and the valve portion and a second web portion extending between the side members at the pivot portion defining a recess therebetween at about the middle portion; a pin bearing located within the bearing holes passing through the recess; and an annular striking member located within the recess rotatably engaging the pin bearing.

The present invention further provides a rocker arm assembly comprising a pair of spaced side members having a valve portion, a middle portion, and a pivot portion, the side members joined by a web; a gusset portion extending downwardly from the middle portion of the side members defining a bearing hole penetrating the gusset portions; wherein the web at the valve portion extends downwardly defining a pair of valve recesses linking either side of the web and bounded by a lower surface of the side members at the valve portion and a front surface of the gusset portion; wherein the web located at the pivot portion extends downwardly adjacent to a rear-face of the gusset portion; wherein a pivot portion defines a pivot hole penetrating the web and the pivot portion; a pin bearing located within the bearing hole; and an annular striking member surrounding and rotatably engaging the pin bearing, wherein the striking member is located at the middle portion between the side members; and a rounded can located above and operatively engaging the striking member.

The present invention further provides a rocker arm for actuating valves in an internal combustion engine comprising a valve portion, a middle portion, and a pivot portion; a pivot hole formed within the pivot portion; and a striking member rotatably mounted within said middle portion.

DETAILED DESCRIPTION OF THE INVENTION

Figure 1:
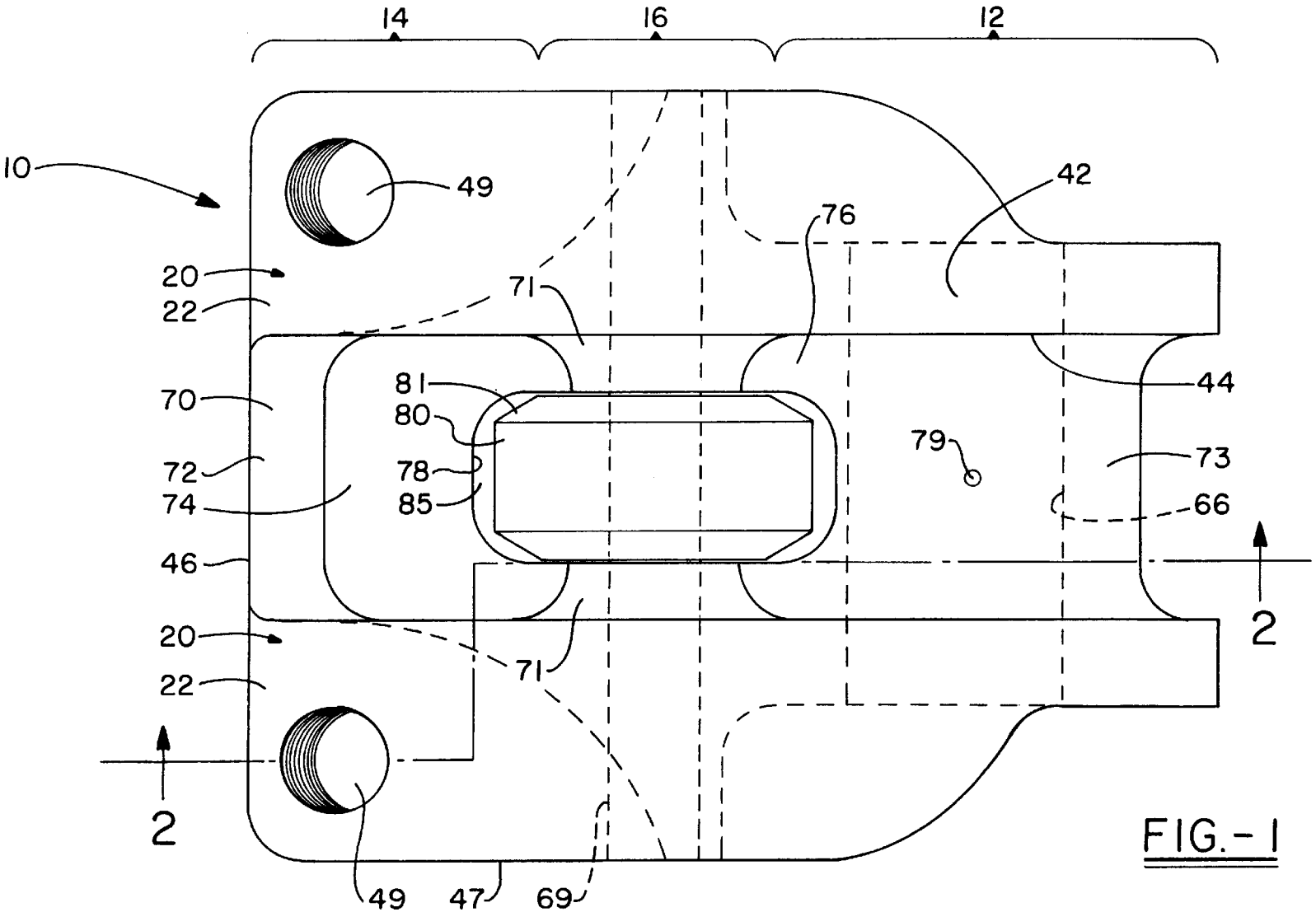
FIG. 1 is a top plan view of a rocker arm according to the present invention.

It has been found that in a known internal combustion engine improved performance can be realized by incorporating a rocker arm according to the present invention. A preferred rocker arm according to the present invention is generally referred to by numeral 10 in the accompanying drawings.

Rocker arm 10 may be generally used within a known internal combustion engine to actuate a pair of valves. As can be appreciated, rocker arm 10 may be modified to actuate one or more valves as necessary.

Rocker arm 10 generally has a pivot portion 12, a valve portion 14, and a middle portion 16 between these portions. Rocker arm 10 may be constructed of conventional materials including, but not limited to, metals, plastics, ceramics, or combinations thereof. The choice of materials may be determined with regard to the operating conditions faced by the rocker arm 10, plus any relevant safety factor. A representative and preferred rocker arm material is 7075 T651 Aluminum.

Rocker arm 10 may be constructed as a unitary structure having a single body. As shown, however, rocker arm 10 uses a web portion between two bodies to reduce the amount of material and, thus, rocker arm weight. Similarly, it should be understood that while the rocker arm 10 depicted in the figures actuates two valves, the rocker arm 10 may be modified to actuate one or more valves. As best shown in FIG. 1, rocker arm 10 preferably includes two side members 20. In the preferred embodiment, side members 20 are mirror images of each other, and thus, for simplicity, description of a single member is intended to encompass both side members 20, unless particularly stated otherwise.

Figure 3:
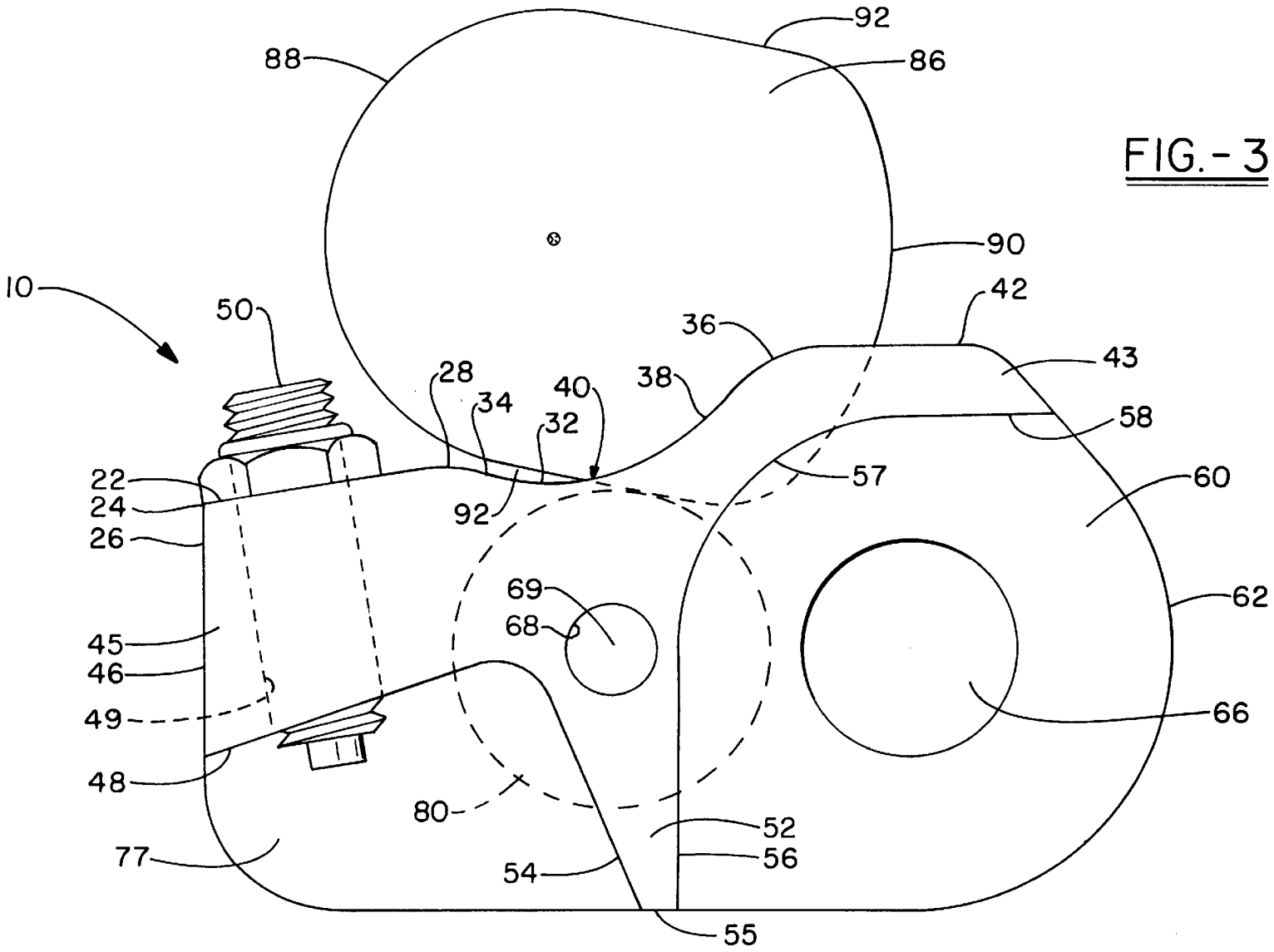
FIG. 3 is a side elevational view of a rocker arm.
Figure 4:
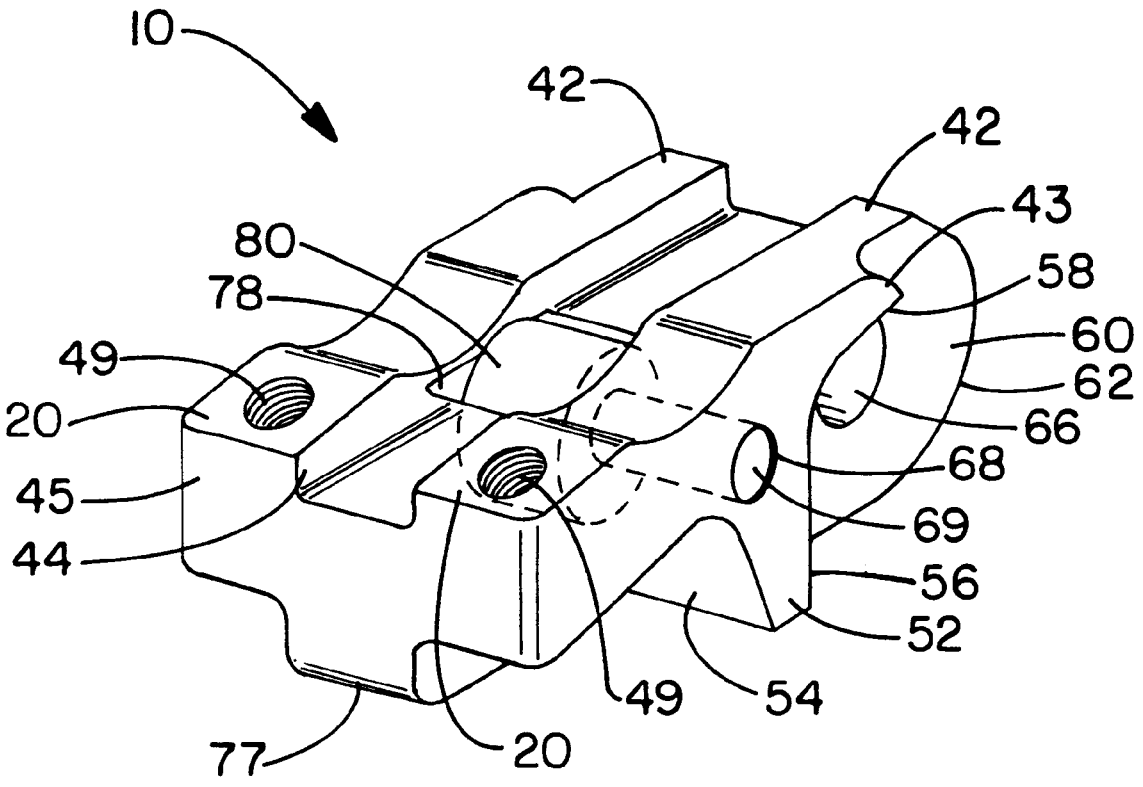
FIG. 4 is a perspective view of a rocker arm, according to the present invention.

The upper surface 22 of side members 20 is largely a function of the surrounding structures within the internal combustion engine. The surface should be constructed with consideration to maintaining proper clearance from these components, allowing free action of rocker arm 10. As shown in FIG. 3, upper surface 22 of rocker arm 10 extends slightly upwardly and rearwardly from a front edge 24 at a slight angle forming a face 26. Face 26 terminates in a first peak 28 which may be rounded over as shown. From the first peak 28 upper surface 22 descends somewhat until reaching a trough 32 forming a first arc 34 therebetween. From the trough 32, upper surface 22 arcuately ascends rearwardly to a second peak 36 forming a second arc 38 between the trough 32 and second peak 36. As shown, first arc 34 and second arc 38 may form a substantially semi-circular depression 40. In a similar fashion to first peak 28, second peak 36 may be rounded over. From second peak 36, upper surface 22 extends substantially horizontally toward the rear of rocker arm 10 forming a flattened shoulder 42.

As best shown in FIG. 1, upper surface 22 of side member 20 may taper inwardly near the pivot portion 12 of rocker arm 10. Side member 20 extends outwardly from a vertical plane formed by inner surface 44 of side member 20 and downwardly from upper surface 22 forming a body portion 45. At the valve end 14, body portion 45 is bounded by upper surface 22, a generally planar front face 46, outer surface 47 of side member 20, and a first flat 48, which forms part of the lower surface of body portion 44.

First flat 48 extends rearwardly and upwardly at an inclination from front face 46, and is sized to accommodate the valve stem. A tappet hole 49 extends downwardly through body portion 44 at valve end 14. Tappet hole 49 may be generally centrally located within valve end 14 or shifted toward the front of valve end 14, as shown. Tappet hole 49 is sized to receive a conventional tappet 50. Tappet 50 adjustably extends beneath first flat 48 to operatively engage the engine's valve stems. To allow for adjustment of the amount of protrusion of tappet 50, tappet hole 49 may be threaded, as shown.

As best shown in FIG. 3, a gusset 52 extends downwardly from body portion 44 at an angle substantially perpendicular to a plane created by first flat 48 forming a forward gusset face 54, which terminates at a gusset end 55. A rear gusset face 56 upwardly extends generally vertically from gusset end 55. A corner round 57 joins rear gusset face 56 to a second flat 58 of the body portion 44. A pivot member 60 extends downwardly from body portion 44 at pivot end 12. As shown in FIG. 3, the pivot portion rear surface 62 may be generally semi-circular. To provide additional strength, pivot member 60 may be provided with a raised rib 64 along rear surface 62. A pivot hole 66 penetrates the pivot member 60, and is generally centrally located therein. Pivot hole 66 is sized to fit a conventional rocker arm shaft. This shaft may be lubricated as will be described below.

A bearing hole 68 is formed within gusset 52, and is sized to accept a pin bearing 69. Pin bearing 69 is mounted within bearing hole 68 and extends between side members 20.

Figure 2:
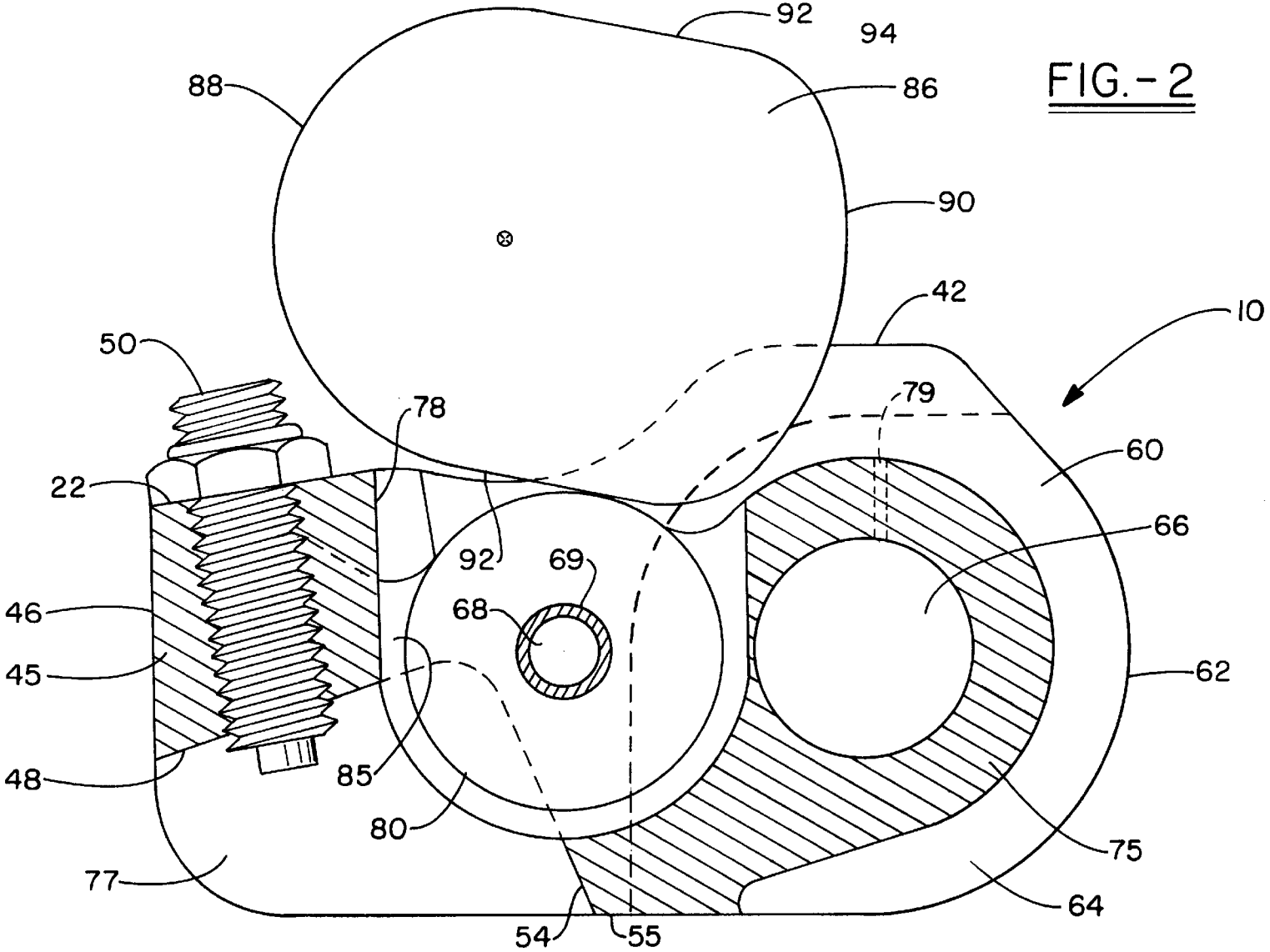
FIG. 2 is a sectional side elevational view of a rocker arm, as may be seen along line 2—2 in FIG. 1.

With reference to FIG. 1, a web 70 spaces side members 20 apart, and is recessed from upper surface 22 of side members 20. The web has a generally planar top surface 72. A front depression 74 is formed within web 70 extending downwardly from top surface 72. Front depression 74 is located between side members 20 and spaced rearwardly from front edge 46. Front depression 74 extends into middle portion 16 and terminates slightly before gusset 52. A rear depression 76 extends from just behind gusset 52 and between side members 20 to substantially the end of pivot portion 12. As shown in FIG. 2, rear depression 72 substantially wraps around the rear and lower portions of the pivot hole circumference leaving a band 75 of material surrounding pivot hole 66. This band 75 may be provided with a lubrication hole 79, for providing lubricant by gravity or otherwise to the shaft, that communicates with pivot hole 66. The front and rear depressions 74, 76 are located on either side of a central web portion 71 that may partially surround pin bearing 69. Preferably, central web portions 71 extend outwardly from inner surface 44 of side members 20 and are truncated by an inner cavity that is described below.

Central web portions 71 may join each other and, in general, form a part of web 70 beneath the cavity. As shown in FIG. 3, a dividing portion 77 of web 70, located forward of central web portion 71 and generally at the valve portion 14, may extend downwardly beyond first flat 48 and between side members 20. Dividing portion 77 may join forward gusset face 54 in an inner radius. The thickness of dividing portion 77 may be optimized with respect to weight considerations, and preferably provides sufficient space to receive value stems and springs on either of its sides.

As best shown in FIG. 2, a recess 78 extends downwardly into web 70 at least partially penetrating the dividing portion 77 and rear web portion 71 Recess 78 may be located between and extend partially into front depression 74, rear depression 76, and central web portions 71, creating a cavity 85 that surrounds pin bearing 69. The cavity 85 is aligned with bearing holes 68, which extend through central web portion 71 creating a space for pin bearing 69 to pass through. The recess cavity 85 is sized to receive a striking member 80, and provide clearance for the rotation of striking member 80. Striking member 80 is rotatably mounted on pin bearing 69, and preferably houses a needle bearing. Bearing 87 may, however, be a single row radial bearing, a double row radial bearing, or other suitable friction-reducing bearing. As shown in FIG. 2, tapered side walls 81 and the outer cylindrical surface of striking member 80 capture the radial bearing 87 against pin bearing 69.

In a known internal combustion engine, a cam 86 would be mounted above striking member 80 and in operative engagement therewith. As shown, one representative cam 86 has a generally semi-circular first end 88 and a flattened substantially circular second end 90 with generally planar sides 92 therebetween. The sides 92 and second end 90 are joined by corner rounds 94. It should be understood that any known cam profile may be used. As the cam 86 rotates it maintains operative contact with rocker arm 10. In a typical internal combustion engine, spring members are mounted around valve stems and are in operative contact with first flat 48. In this way, as the cam 86 transmits a downward force to rocker arm 10, causing rocker arm 10 to rotate about the rocker arm shaft, the spring members compress. As the cam 86 rotates away from rocker arm 10, the spring members expand, maintaining contact between cam 86 and striking member 80. Since striking member 80 is free to rotate, frictional forces between the cam 86 and striking member 80 are at least partially converted into rotational motion of striking member 80. While the striking member 80 rotates, the cam 86 is still permitted to actuate the rocker arm 10 in the vertical direction.

It should be apparent that a rocker arm 10 according to the above description satisfies the objects of the present invention. While only one embodiment of the present invention has been described, it should be understood that modifications or substitutions may be made without deviating from the spirit of the present invention. Therefore, the scope of the present invention should be measured with reference to the following claims.

What is claimed is:

1. A rocker arm comprising:

two spaced side members having a pivot portion, a middle portion, and a valve portion, said middle portion of each side member defining a bearing hole, and each of said pivot portions defining a laterally extending pivot hole;

a first web portion extending between said side members at said valve portion and a second web portion extending between said side members at said pivot portion defining a recess therebetween at about said middle portion;

a pin located within said bearing holes passing through said recess; and an annular striking member located within said recess rotatably engaging said pin.

2. The rocker arm of claim 1 further comprising a gusset extending downwardly from said side members wherein said bearing holes are located within said gusset.

3. The rocker arm of claim 2 wherein said valve portions of said side members have a generally planar lower surface.

4. The rocker arm of claim 3 further comprising a tappet hole formed within each side member at said valve portion and extending therethrough, and a pair of tappets secured within said tappet holes.

5. A rocker arm according to claim 1, further comprising a divider extending downwardly between said side members defining a pair of recesses at said valve portion.

6. The rocker of claim 4 wherein said first web and said second web join beneath said recess forming a lower surface thereof.

7. The rocker of claim 6 further comprising a lubrication hole formed within said second web portion and in communication with said pivot hole.

8. A rocker arm for actuating a pair of valves in an internal combustion engine having a rocker arm shaft the rocker arm comprising:

a pair of spaced side members each having a top and a bottom, a valve portion, a middle portion and a pivot portion, wherein said side members terminate in a substantially semi-circular edge at said pivot portion;

said side members including a body portion extending laterally outward from a top portion of said side member adjacent said valve portion, a gusset portion extending laterally outward from said side member at said middle portion, wherein said gusset portion and said body portion define a recess for receiving a portion of the valves, and a shoulder portion extending laterally outward from said top portion of said side members adjacent said pivot portion, wherein said shoulder portion and said gusset portion define a second recess adjacent said pivot portion of said side members;

a raised rib formed on said semi-circular edge of said pivot portion;

a web connecting said spaced side members, said web defining a recess between said middle portions of said side members;

a pin supported by said gusset portion of said side members, said pin extending is between said side members passing through said recess formed in said web; and a striking member rotatably mounted on said pin.

* * * * *